US006454444B1

(12) United States Patent
Wang

(10) Patent No.: US 6,454,444 B1
(45) Date of Patent: Sep. 24, 2002

(54) MOLDED HINGE ASSEMBLY

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/502,795

(22) Filed: Feb. 11, 2000

(51) Int. Cl.[7] ..... E05D 7/10

(52) U.S. Cl. ..... 362/374; 362/375; 16/267; 16/243; 16/268

(58) Field of Search ..... 362/374, 375, 362/362; 16/267, 260, 266, 268, 261, 243, 224

(56) References Cited

U.S. PATENT DOCUMENTS

| | | | | |
|---|---|---|---|---|
| 1,836,845 A | | 12/1931 | Halvorson, Jr. | |
| 2,534,992 A | | 12/1950 | Reid | |
| 2,836,709 A | | 5/1958 | Van Dusen, Jr. | |
| 2,975,271 A | | 3/1961 | Dvorak | |
| 3,071,683 A | | 1/1963 | Queale | |
| 3,096,029 A | | 7/1963 | Berge | |
| 3,210,538 A | | 10/1965 | Picha et al. | |
| 3,281,588 A | | 10/1966 | Spinetta | |
| 3,340,393 A | | 9/1967 | Franck et al. | |
| 3,654,453 A | | 4/1972 | Jablonski | |
| 3,697,743 A | | 10/1972 | Eargle | |
| 3,883,732 A | | 5/1975 | Peterson et al. | |
| 3,983,387 A | | 9/1976 | Van Steenhoven et al. | |
| 4,255,781 A | | 3/1981 | Plemmons et al. | |
| 4,317,163 A | | 2/1982 | Bout | 362/362 |
| 4,403,278 A | | 9/1983 | Flood | 362/396 |
| 4,538,217 A | | 8/1985 | Ewing et al. | 362/375 |
| 4,654,768 A | | 3/1987 | Dryman et al. | 362/374 |
| 5,121,309 A | | 6/1992 | Ewing et al. | 362/226 |
| 5,127,132 A | * | 7/1992 | Karlin | 16/261 |
| 5,289,358 A | | 2/1994 | Halemeier | 362/275 |
| 5,376,020 A | | 12/1994 | Jones | 439/537 |
| 5,662,407 A | | 9/1997 | Fischer et al. | 362/147 |
| 5,803,585 A | | 9/1998 | Littman et al. | 362/147 |
| 5,803,590 A | | 9/1998 | Wedell et al. | 362/226 |
| 5,927,843 A | | 7/1999 | Haugaard et al. | 362/147 |
| 5,940,934 A | * | 8/1999 | Turner | 16/257 |
| 5,956,809 A | * | 9/1999 | Hodgson | 16/224 |
| 6,116,749 A | | 9/2000 | Quiogue et al. | 362/148 |
| 6,149,280 A | | 11/2000 | Quiogue et al. | 362/147 |

FOREIGN PATENT DOCUMENTS

| | | |
|---|---|---|
| DE | 4304587 A1 | 10/1993 |
| GB | 837214 | 6/1960 |

* cited by examiner

*Primary Examiner*—Thomas M. Sember
(74) *Attorney, Agent, or Firm*—Mark S. Bicks; Jeffrey J. Howell; Alfred N. Goodman

(57) ABSTRACT

A lighting fixture frame with two diecast hinges. One part of each hinge has a split trough molded-in with the body of the mounting member. One side of the split trough has a molded ball rib. The second part of each hinge has two pins molded-in with the lens frame. The pins extend parallel to the edge of the frame. One pin from the hinge has a ball groove located around its base. The ball rib and ball groove slide together for centering and allowing ample clearance between the body and the frame. A lock can releasably cover one pin of each hinge, to retain pins in the troughs, while allowing the hinges to pivot.

36 Claims, 6 Drawing Sheets

MOLDED HINGE ASSEMBLY

FIELD OF THE INVENTION

The present invention relates to a light fixture that has a straight molded dual pin hinge design. The body of the fixture is cast with a molded-in hinge component that has a split trough with a ball rib in one trough. The lens frame is cast with a molded-in hinge component that has dual pins extending therefrom and a ball groove at the base of one of the pins. The dual pins slide into the trough with the ball rib surrounding the ball groove and acting as a self-centering device that allows for ample room between the mounting member and lens frame for pivoting movement there between.

BACKGROUND OF THE INVENTION

Access to the interior of a light fixture is generally necessary to change the light source or alter the direction the light projects by adjusting a reflector assembly. Many light fixtures allow interior access through a pivoting lens frame attached to a relatively stationary mounting member. The lens frame is usually attached using a hinge, which must enable the lens frame to open and allow full, unrestricted access to the interior of the light fixture.

Conventional hinge designs for luminaires commonly use a cantilevered single pin design. The pin single is usually relatively long making the hinge more likely to fail due to significant shear and compression forces from the weight of the corresponding hinged device. In addition, the hinge parts are individually diecast and attached to the lens frame or mounting member through various methods, such as screws or glue. This design creates a hinge that protrudes from the mounting member and frame. If the hinge is made too compact to avoid protrusions, the hinge will not have ample clearance and may bind.

When multiple hinges are used and spaced substantial distances from each other, relatively large tolerances must be built into the diecast mold. These tolerances require that a hinge be moved away from the hinged element to allow enough clearance for the pivoting of the hinged parts. Many hinges are designed to be as compact as possible for a smooth appearance, but they still must allow for clearance tolerances that must be built into the mold, limiting compactness.

If a hinge component is molded-in with its corresponding hinged element, cams, lifters, or secondary operations are generally necessary. Cams and lifters enable a cast to be removed from a mold even if the mold has undercuts. Designing a diecast hinge that can be straight molded without using any of these procedures is difficult. Use of cams and lifters to remove a mold from its cast only adds time and expense to a molding procedure. The same is true for secondary operations. Secondary operations are added steps after a diecast is removed from a mold, such as drilling a hole for a screw. Therefore designing a hinge assembly that can be manufactured without using cams, lifters, or secondary operations and that is simple to use and cost effective to make is important.

SUMMARY OF THE INVENTION

Accordingly, an object of the present invention is to provide light fixture hinge assemblies for the mounting member and lens frame that can be straight molded without cams, lifters or secondary operations, thereby reducing the manufacturing time and expense.

Another object of the present invention is to provide a light fixture hinge that is self-centering with a dual pin and split trough configuration, providing ample clearance between the dual pin component and the split trough component while maintaining a smooth fit and finish.

Still another object of the present invention is to provide a light fixture hinge that is molded-in enabling its trough and pins to be located close to the edges of the hinged parts.

Yet another object of this invention is to provide a light fixture hinge having a dual pin and split trough configuration that is diecast and molded simultaneously with the hinged part, producing a strong, compact, and unobtrusive hinge that is aesthetically pleasing.

The foregoing objects are basically attained by providing a hinge assembly for a light fixture having two pieces. The first piece has a unitary hinge element having first and second sections with a ball rib located in the first section. The second piece has a unitary hinge element, which slides into the first unitary hinge element, and has a first and second pin, the first pin having an annular ball groove.

By forming the light fixture hinge assembly in this manner, the resultant design has exceptional strength. The straight molded dual pin design locates the trough and the hinge pins close to the edges of mounting member and the body. This configuration also provides a compact, unobtrusive design with minimum protrusion from the pin assembly and the trough assembly.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE PREFERRED EMBODIMENT

Figure 1:
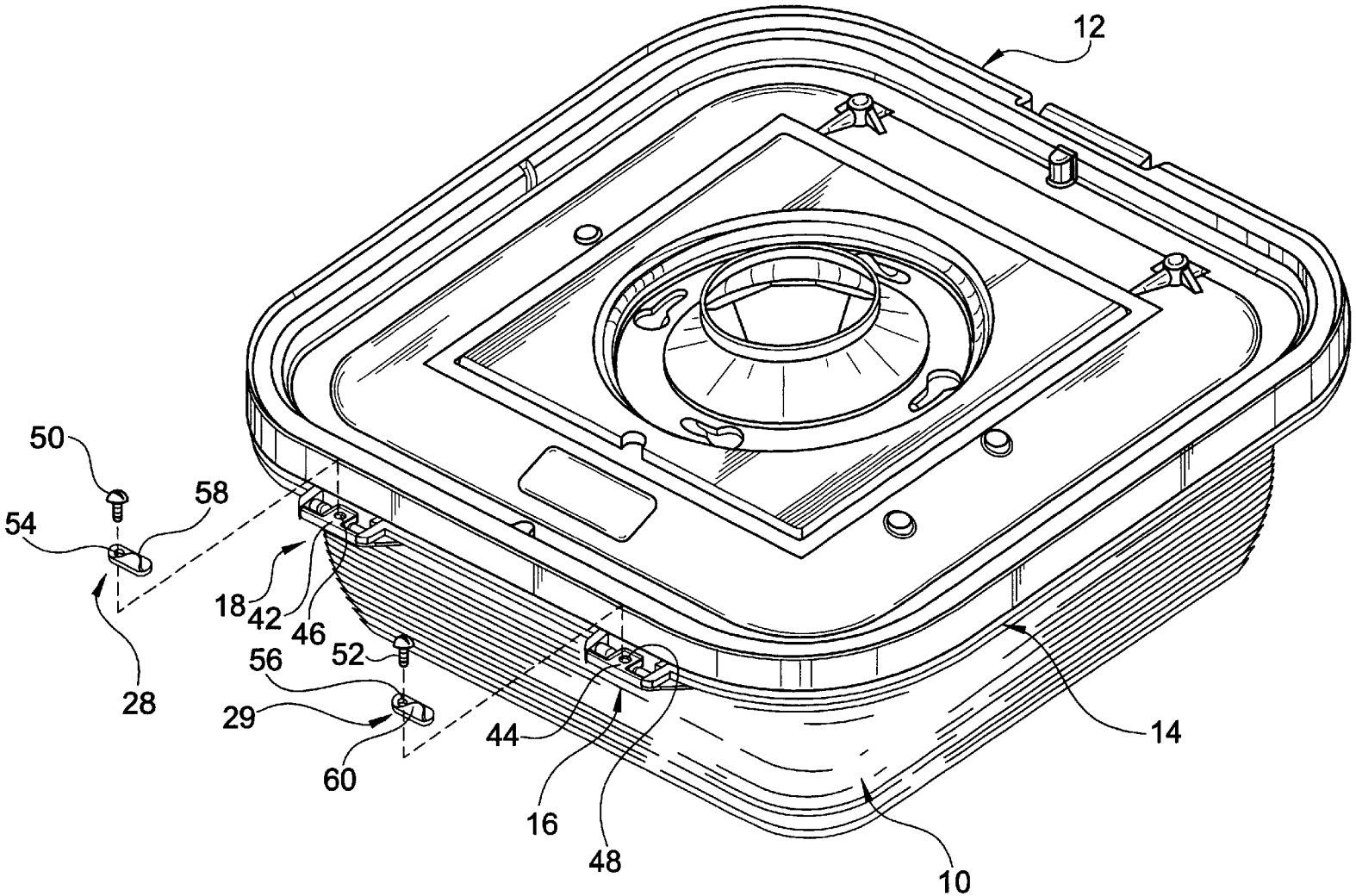
FIG. 1 is a top perspective view of a light fixture with a molded-in hinge assembly, in accordance with an embodiment of the present invention.

Referring initially to FIG. 1, a light fixture 10 according to the present invention is formed from a stationary mounting member 12, coupled to lens frame 14 through hinges 16 and 18 and a latch member. The hinges comprise pin assemblies 20 and 22 that slide into split trough assemblies 24 and 26. The pin assemblies are releasably held in place by locking members 28 and 29. Locking mechanisms 28 and 29 are pivoted between locked and unlocked positions, enabling lens frame 14 to be completely removed from the mounting member. This allows easier mounting and access to the interior of the lighting fixture, and easier replacement of some of the components.

The latch member (not shown) releasably engaging the mounting member and the lens frame are disclosed in concurrently filed U.S. patent application Ser. No. 09/502, 801 of James Wang et al. entitled Latch For Optical Assembly, the subject of which is hereby incorporated by reference.

Mounting member 12 and lens frame 14 can be any shape, but are preferably substantially rectangular. Both mounting member 12 and lens frame 14 are made of any metal that can be diecast and straight molded into the desired rectangular shape. Straight molding allows the cast to be removed without the use cams and lifters and does not require any secondary operations, such as drilling. In straight molding, the cast is removed directly out of the mold and has no undercuts. Straight molded designs are generally cheaper and easier to manufacture than designs having undercuts or secondary operations.

Figure 2:
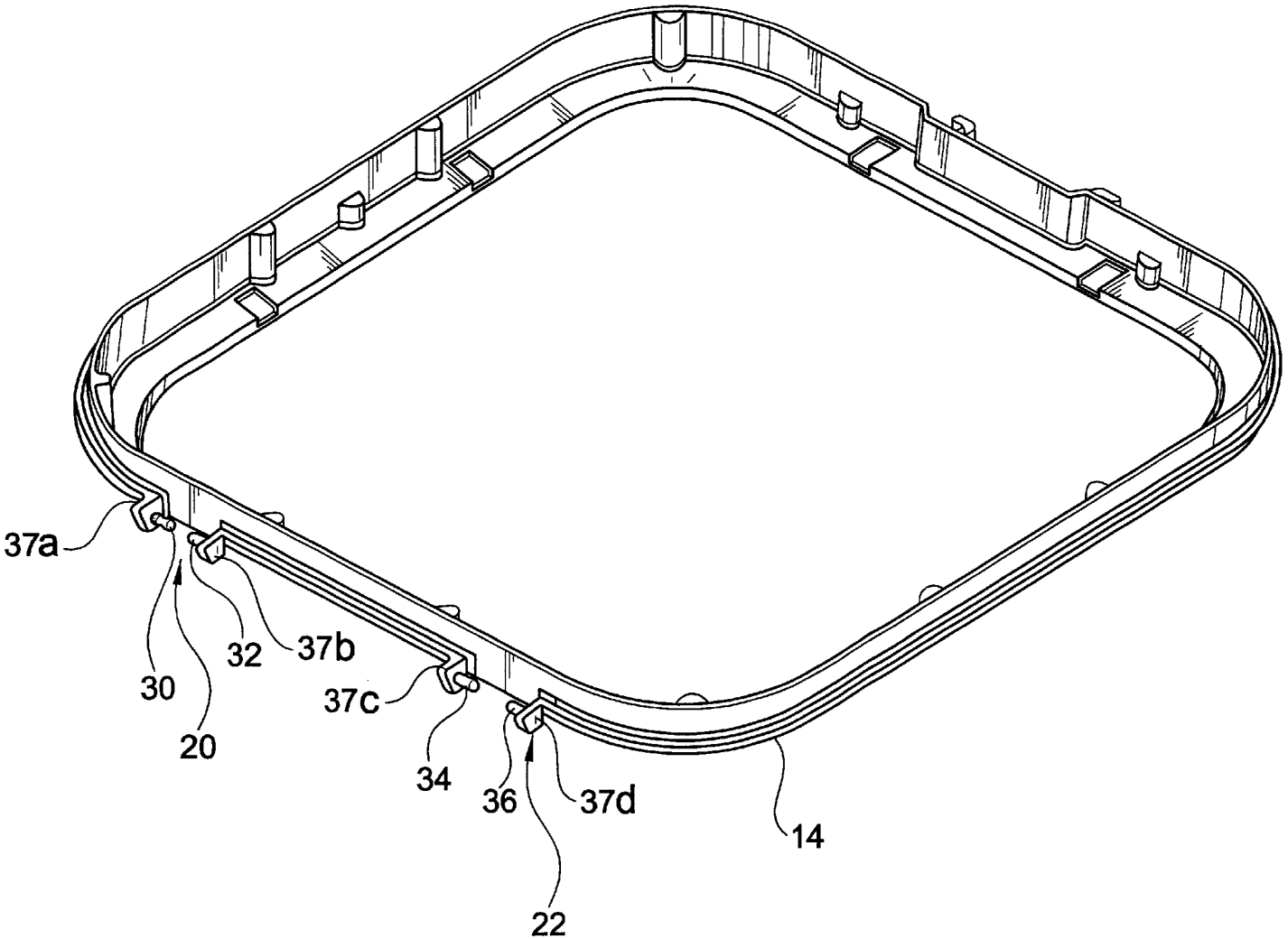
FIG. 2 is a detailed perspective view of lens frame of the light fixture illustrated in FIG. 1.
Figure 3:
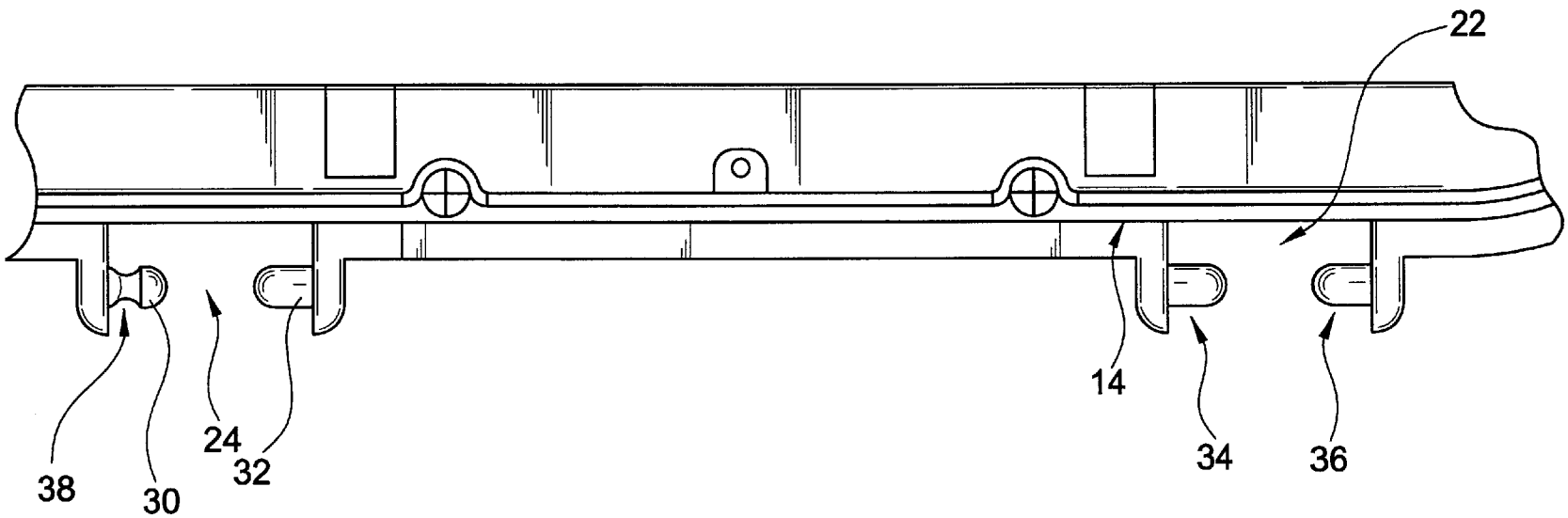
FIG. 3 is a partial, enlarged top planer view of the pin assembly illustrated in FIG. 1.
Figure 5:
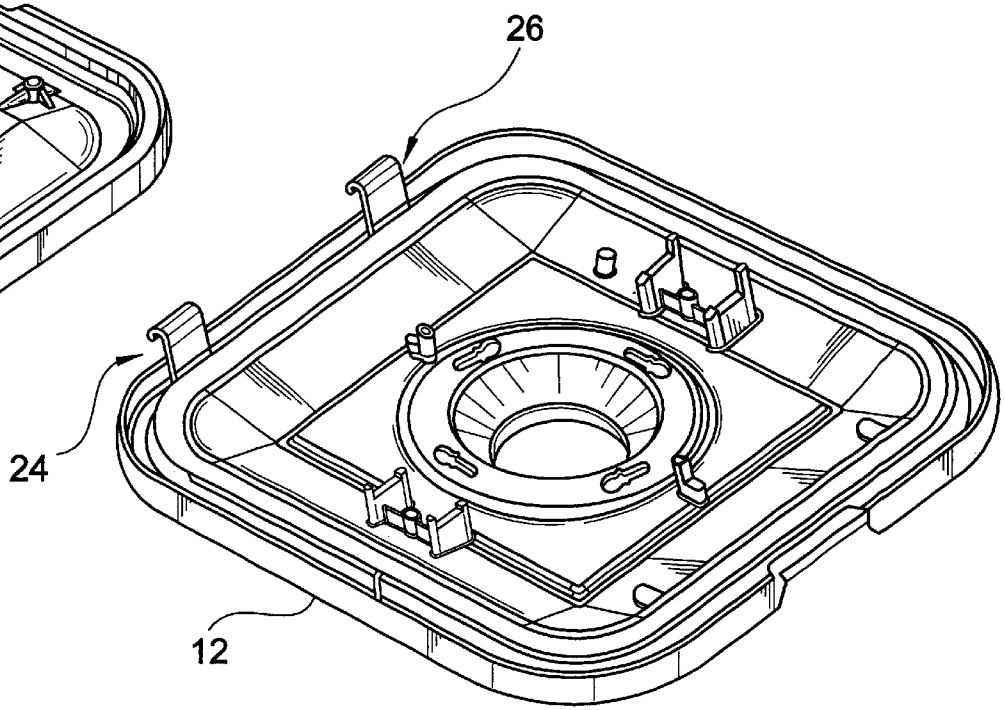
FIG. 5 is a bottom perspective view of the mounting member of the light fixture illustrated in FIG. 1.
Figure 4:
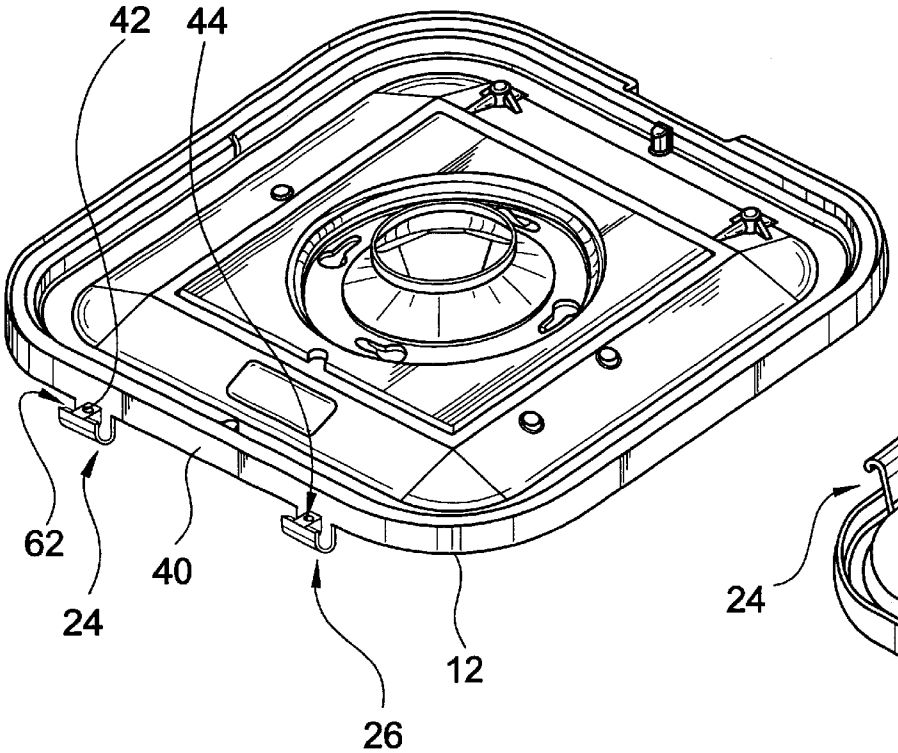
FIG. 4 is a top perspective view of the mounting member of the light fixture illustrated in FIG. 1.

Lens frame 14 and pin assemblies 20 and 22 are simultaneously diecast as a unitary, one-piece structure. As shown in FIGS. 2 and 3, pin assemblies 20 and 22 protrude from the side of lens frame 14, pin assembly 20 has a pair of pins 30 and 32, while pin assembly 22 has a pair of pins 34 and 36. The pins of each pair extend from hinge supports 37*a,* 37*b,* 37*c,* and 37*d* toward each other and are parallel with the adjacent edge of lens frame 14. Each pin is centered on the same longitudinal axis, with the adjacent ends of each pin pair spaced apart. The hinge supports extend laterally and perpendicularly from the lens frame and face the end of trough assemblies 24 and 26 when the pin assemblies and trough assemblies are coupled together. Pins 30, 32, 34, and 36 are relatively short, compared to the overall width of the pin assemblies 20 and 22, making the moment arm of each pin shorter than conventional pins. The size of each pin and the use of pin pairs for each hinge allows each pin to support half the hinge load and makes shearing of the pins more difficult.

As shown on FIG. 3, each pin is substantially a right circular cylinder of approximately the same length. Pin 30, however, has a molded-in ball groove 38 adjacent its base that acts as a self-centering mechanism when combined with trough 24.

Figure 7:
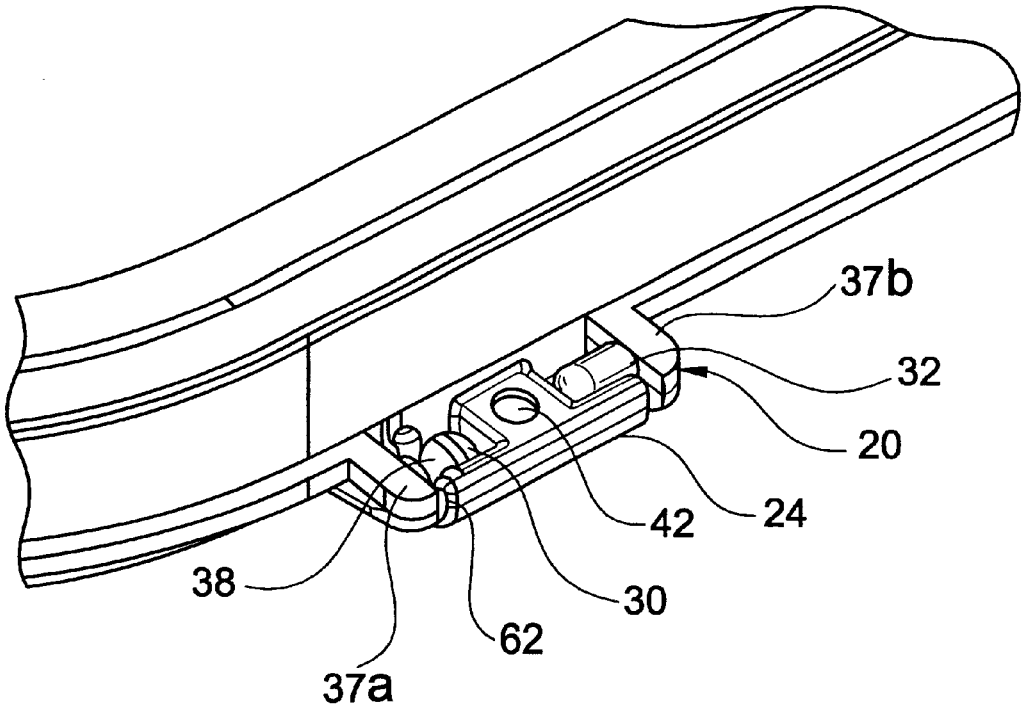
FIG. 7 is a partial, enlarged perspective view of the lens frame pin assembly slidably received in the mounting member split trough assembly as illustrated in FIG. 1.

Mounting member 12 and trough assemblies 24 and 26 are also simultaneously cast, making the trough assemblies unitary and nonremoveable components of mounting member 12. The trough assemblies are U-shaped and extend from wall 40 of mounting member 12 making one portion or side 41 of the trough assembly a coplanar extension of wall 40, allowing smooth operation when pins 30, 32, 34, and 36 are fitted within the trough assemblies 24 and 26. In addition, this pin/trough configuration puts sides 41 of trough assemblies 24 and 26 under tensioning forces. As seen in FIGS. 1 and 7, pin assemblies 20 and 22 would create a downward force on trough assemblies 24 and 26, putting pressure on the bottom of the trough and creating a tensioning force in sides 41 between the trough assemblies and mounting member 12. Contrary to conventional designs, where a pin causes shear and compression force on its mating hinge part, the trough assemblies 24 and 26 of the present invention can withstand greater load by avoiding shear and compression loads.

Figure 6:
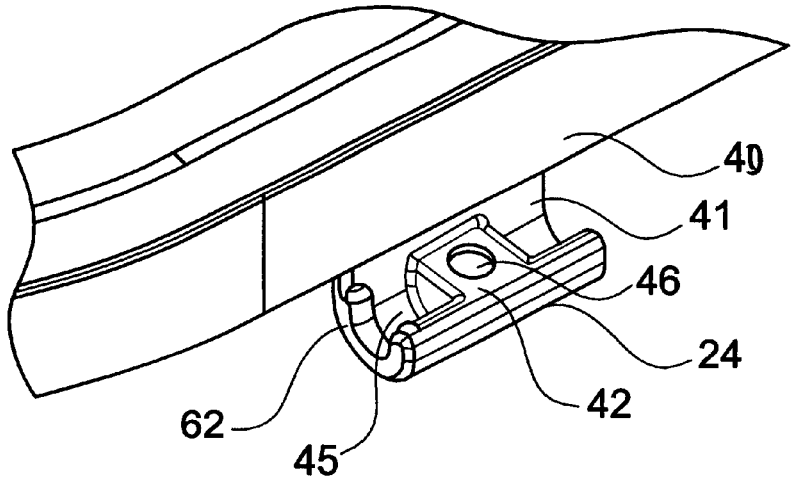
FIG. 6 is a partial, enlarged perspective view of the mounting member split trough assembly illustrated in FIG. 1.

Dividing members 42 and 44 separate each trough assembly 24 and 26 into two equal sections. As seen in FIG. 6, one section 45 of trough assembly 24 has a raised ball rib 62. The ball rib is molded-in with trough assembly 24 during casting and is sized to be received within ball groove 38. The engagement of the ball rib and groove centers the hinge, eliminating any significant side to side sliding and allowing for ample clearances between the pin assemblies 20 and 22 and the trough assemblies 24 and 26. The hinge is also centered by the inner surfaces of the hinge supports being closely adjacent the opposite ends of the troughs.

Providing clearance between the pin assemblies and the trough assemblies ensures equal gaps between the mounting member 12 and the lens frame 14, while providing a smooth fit and finish. The combination of the ball rib and groove creates a tight, but smooth fit between the pin assemblies and the trough assemblies, and limits the movement of pin 30. Limiting the movement of pin 30 is possible by designing a small pin assembly with even a smaller diameter around the ball groove. By limiting the size of the ball rib and groove and only using one ball rib and groove mechanism, the present hinge mold can be designed with tighter tolerances than could normally be built into a similar hinge configuration. Inherently, in standard tolerancing, a die cast mold can hold tight tolerances with small parts. Larger parts require more tolerances in the mold resulting in an imprecise fit when coupled with its respective part. Tighter tolerances in the mold allow the hinges to be molded close to the mounting member 12 and the lens frame 14 and still have more than enough clearance to avoid binding of the hinge.

The dividing members are straight molded with screw holes 46 and 48. Screw holes 46 and 48 receive screws 50 and 52 and enable locking members 28 and 29 to engage and lock pin assemblies 20 and 22 into trough assemblies 24 and 26.

Figure 8:
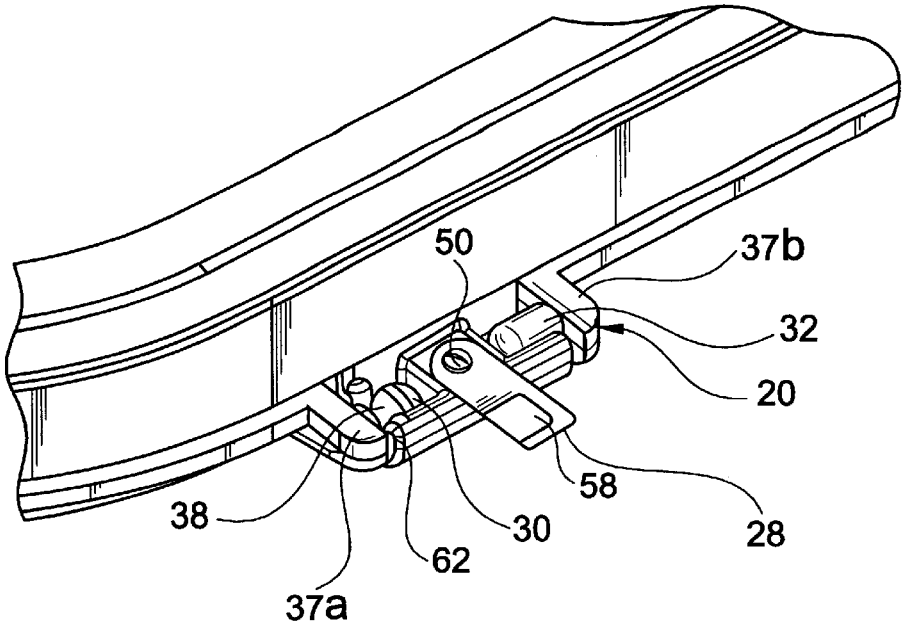
FIG. 8 is a partial, enlarged perspective view of the lens frame pin assembly slidably received in the mounting member split trough assembly as illustrated in FIG. 1 with the locking member in the unlocked position.
Figure 9:
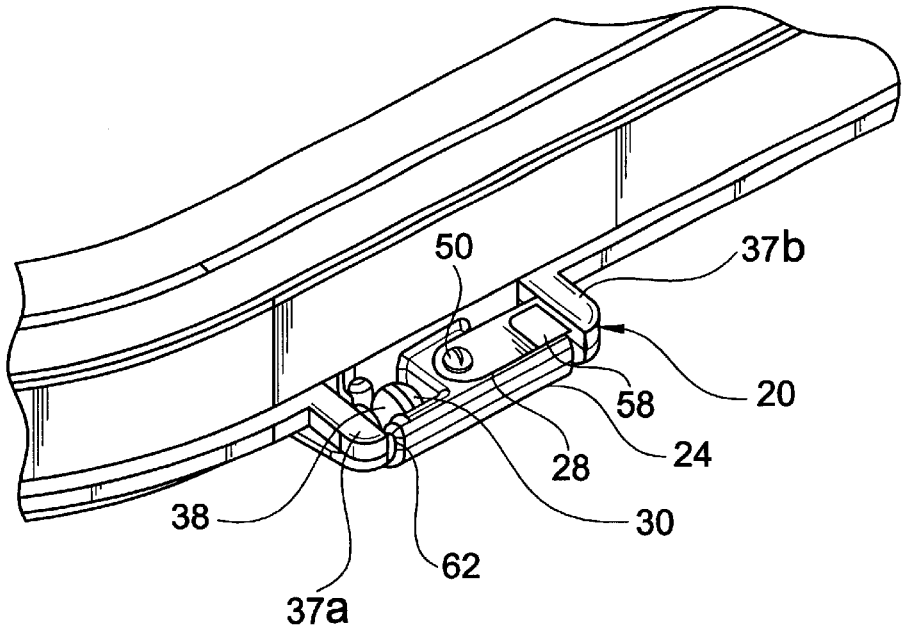
FIG. 9 is a partial, enlarged perspective view of hinge assembly of FIG. 1 with the locking member in the locked position.

Locking members 28 and 29 are substantially rectangular metal plates with holes 54 and 56 in one end. Holes 54 and 56 enable the locking members to act as levers when screws 50 and 52 are inserted. Locking members 28 and 29 have tabs 58 and 60, respectively, that act as handles and are perpendicular to and extend from the locking members. To lock the pin assemblies and the trough assemblies together, locking members are pivoted from their open position, as shown if FIG. 8, around screws 50 and 52 to a locked position, as shown in FIG. 9. The locking members are sized so that when they are in their locked position, their metal plates entirely cover pins 30 or 32 and 34 or 36 and one section of the trough assemblies. In their locked positions, the pin assemblies can not be removed from the trough assemblies, but still allow the hinge to pivot about its axis. To unlock the pin assemblies from the trough assemblies, locking members 28 and 29 are pivoted around screws 50 and 52 until the locking members are substantially perpendicular with the adjacent edge of lens frame 14.

Once both of the locking members 28 and 29 have been pivoted into their unlocked position, removal of lens frame 14 is relatively simple. Lens frame is unlatched from mounting member 12 and opened to a relatively obtuse included angle. Pin assemblies 20 and 22 are then slidably removed from trough assemblies 24 and 26. Removal of the pin assemblies from the trough assemblies completely separates the lens frame from the mounting member. For reattachment of the lens frame to the mounting member, the procedure above is reversed.

While the two pin assembly is the preferred design it is possible to cast the mold with only one pin and no split trough. As long as the pin and trough have the ball rib and groove self-centering mechanism the hinge will still perform as desired.

While a particular embodiment has been chosen to illustrate the invention, it will be understood by those skilled in the art that various changes and modifications can be made therein without departing from the scope of the invention as defined in the appended claims.

What is claimed is:

1. A hinge assembly for a light fixture, comprising:

a first member with a unitary first hinge element having first and second sections, said first section having a ball rib;

a second member with a unitary second hinge element slidably received within said first hinge element and having first and second pins, said first pin having an annular ball groove; and a hinge lock coupled to said first element and movable between a locked position extending over one of said sections to trap the respective pin therein and an unlocked position spaced from said section to allow removal of said pins from said sections.

2. A hinge assembly according to claim 1 wherein said first element is U-shaped.

3. A hinge assembly according to claim 1 wherein said first and second pins are axially centered on the same longitudinal axis.

4. A hinge assembly according to claim 1 wherein said first and second elements are straight molded.

5. A hinge according to claim 1 wherein said first and second pins are slidably received within said first and second sections.

6. A hinge assembly according to claim 5 wherein said annular ball groove slidably receives said ball rib.

7. A hinge assembly according to claim 1 wherein said hinge lock rotates around a screw to move from said locked position to said unlocked position.

8. A hinge assembly according to claim 1 wherein said hinge lock consists of a flat plate with a handle extending therefrom.

9. A hinge assembly according to claim 1 wherein said first and second elements are straight molded.

10. A hinge assembly according to claim 1 wherein, said first member is U-shaped and extends along a hinge axis; and said first and second sections are separated by a wall extending transverse to said hinge axis.

11. A hinge assembly according to claim 10 wherein, said wall is unitary with said first member.

12. A hinge assembly according to claim 10 wherein, said wall is straight molded and comprises a screw hole.

13. A hinge assembly according to claim 10 wherein, said first and second sections are separated by a wall.

14. A hinge assembly according to claim 13 wherein, said wall is straight molded with a screw hole, said screw hole receiving said screw around which the hinge lock rotates.

15. A hinge assembly according to claim 1 wherein, said first element is a laterally open, U-shaped trough; and said ball rib extends radially inwardly from said U-shaped trough and along a generally semi-circular arc.

16. A hinge assembly according to claim 15 wherein, said first and second pins extend coaxially in opposite directions from parallel, spaced supports, and extend into said first and second sections, respectively.

17. A hinge assembly according to claim 16 wherein, said ball rib is received in said ball groove.

18. A hinge assembly according to claim 1 wherein, said hinge lock rotates around a fastening member to move from said locked position to said unlocked position.

19. A hinge assembly according to claim 1 wherein, said hinge lock includes a flat plate with a handle extending therefrom.

20. A hinge assembly comprising:

a straight molded first member with a unitarily formed first hinge element having a trough and a separating member dividing said trough into first and second sections;

a straight molded second member with a unitarily formed second hinge element having first and second pins, said pins extending coaxially;

a ball rib within said first section of said trough;

a ball groove circumferentially around said first pin and slidably receiving said ball rib, said ball groove and ball rib centering said first and second hinge elements; and a hinge lock coupled to said first element and is movable between a locked position extending over one of said sections to trap the respective pin therein and an unlocked position spaced from said section to allow removal of said pins from said sections.

21. A hinge assembly according to claim 20 wherein said first hinge element has a screw hole.

22. A hinge assembly according to claim 20 wherein said hinge lock rotates around a screw to move from said locked position to said unlocked position.

23. A hinge assembly according to claim 22 wherein said hinge lock consists of a flat plate with a handle extending therefrom.

24. A light fixture, comprising:

a body;

a movable lens frame;

a first hinge element coupled to said body and having a trough and a member dividing said trough into first and second sections, one side of said trough being coplanar said body;

a second hinge element coupled to said frame, and having first and second pins extending parallel to said frame;

a ball groove located circumferentially around said first pin; and a ball rib located within said first section of said trough, and slidably received within said ball groove;

whereby said ball rib and ball groove center and allow ample clearance between said first hinge element and said second hinge element.

25. A light fixture according to claim 24 wherein said first element is molded-in with said body.

26. A light fixture according to claim 24 wherein said second element is molded-in with said frame.

27. A light fixture according to claim 24 further comprising a hinge lock coupled to said first element and is movable between a locked position extending over one of said sections to trap the respective pin therein and an unlocked position spaced from said section to allow removal of said pins from said sections.

28. A hinge assembly according to claim 18 wherein said hinge lock rotates around a screw to move from said locked position to said unlocked position.

29. A hinge assembly for a light fixture, comprising:

a first member with a unitary first hinge element having first and second sections, said first section having a ball rib; and a second member with a unitary second hinge element slidably received within said first hinge element and having first and second pins, said first pin having an annular ball groove;

wherein said first member is U-shaped and extends along a hinge axis; and said first and second sections are separated by a wall extending transverse to said hinge axis.

30. A hinge assembly according to claim 29 wherein, said wall is unitary with said first member.

31. A hinge assembly according to claim 29 wherein, said wall is straight molded and comprises a screw hole.

32. A hinge assembly according to claim 29 wherein, said first and second sections are separated by a wall.

33. A hinge assembly according to claim 32 wherein, said wall is straight molded with a screw hole, said screw hole receiving said screw around which the hinge lock rotates.

34. A hinge assembly for a light fixture, comprising:

a first member with a unitary first hinge element having first and second sections, said first section having a ball rib; and a second member with a unitary second hinge element slidably received within said first hinge element and having first and second pins, said first pin having an annular ball groove wherein said first element is a laterally open, U-shaped trough; and said ball rib extends radially inwardly from said U-shaped trough and along a generally semi-circular arc.

35. A hinge assembly according to claim 34 wherein, said first and second pins extend coaxially in opposite directions from parallel, spaced supports, and extend into said first and second sections, respectively.

36. A hinge assembly according to claim 35 wherein, said ball rib is received in said ball groove.

* * * * *